US007247045B1

(12) United States Patent
Arellano

(10) Patent No.: US 7,247,045 B1
(45) Date of Patent: Jul. 24, 2007

(54) MODULAR CONNECTION ASSEMBLY

(76) Inventor: Jose Luis Arellano, Calle 4 No. 62 - La Plata, Provincia de Buenos Aires (1900) (AR)

( * ) Notice: Subject to any disclaimer, the term of this patent is extended or adjusted under 35 U.S.C. 154(b) by 0 days.

(21) Appl. No.: 11/481,191

(22) Filed: Jul. 5, 2006

(30) Foreign Application Priority Data

Jul. 5, 2005 (AR) ..... P050102784

(51) Int. Cl.
*H01R 11/20* (2006.01)

(52) U.S. Cl. ..... 439/416; 439/717

(58) Field of Classification Search ..... 439/715, 439/717, 416, 431, 716, 402, 411, 415, 709
See application file for complete search history.

(56) References Cited

U.S. PATENT DOCUMENTS 1,030,817 A 6/1912 Honold
2,699,533 A * 1/1955 Harnett ..... 439/717
3,720,778 A * 3/1973 Woertz et al. ..... 174/59
3,771,104 A * 11/1973 Clark ..... 439/415
3,872,416 A * 3/1975 Kinasi ..... 337/201
5,266,057 A * 11/1993 Angel et al. ..... 439/724
6,000,963 A 12/1999 Harting et al.
6,074,240 A * 6/2000 Bradshaw et al. ..... 439/412
6,589,070 B1 * 7/2003 Lias et al. ..... 439/507
6,612,865 B2 * 9/2003 Lias et al. ..... 439/507

* cited by examiner

*Primary Examiner*—Tulsidas C. Patel
*Assistant Examiner*—Harshad C Patel
(74) *Attorney, Agent, or Firm*—Amin Hallihan LLC

(57) ABSTRACT

The modular connection assembly comprises a connector (4) made of insulating material, a conductor connecting bridge (10) and a fixing and contact member (9); the connector (4) has side socket members (5) to relate to similar units (4) and it also includes passages (6)(7)(8) for cables (3), for bridges (10) and for fixing members (9); the bridge (10) includes modular sections (10*a*) and threaded holes (10*b*) for the fixing member (9); which are screws ending in contact ends (9*a*) able to perforate the sheath (3*a*) of the conductor cable (3) and contact it. The side socket member (5) allow the group of several connectors (4) integrated in a modular connection set. The conductor cables (3) are inserted into the first passage (6) of the connectors (4). The bridges (10), after cutting and separating the unnecessary modular sections (10*a*), are inserted into the second passage (7) of the connectors (4).

10 Claims, 3 Drawing Sheets

MODULAR CONNECTION ASSEMBLY

PRIORITY CLAIM

This application claims the benefit of the filing date of Application No. P050102784 filed in Argentina on Jul. 5, 2005.

FIELD OF INVENTION

The present invention relates to the field of electricity and the essential electrical assembly for the connection of electrical conductors.

More particularly, it deals with a modular connection assembly which allows the connection of a power line to one or more electrical devices without the need to switch off the power line when it comes to connecting, modifying the connection, switching off, making branches, etc.

DESCRIPTION OF PRIOR ART

Different connection devices are known which allow the connection to a power line by means of electrical devices such as switchgears, differential circuit breakers, thermomagnetic switchgears, contactors, terminals and electrical elements in general.

Among those known devices, we can mention the different types of terminals which provide contact cells intended to the input of the input cables and from where the output conductors come out.

These terminals have the inconvenience that the conductors corresponding to the different phases enter into very close positions and in addition, they are at the same level.

Therefore, in order to make the connections, the electrical current supply should be switched off so as to avoid inconveniences. In addition, prior to making the connection, the insulation sheath of the conductor cable should be peeled so that its conductor core suitably contacts the corresponding parts of the terminal.

On the other hand, conventional terminals are made with predetermined configurations. This requires the installer to change the terminals when the configuration of the connections are changed.

For example:

U.S. Pat. No. 3,720,778 discloses a device intended to the connection between multipolar electrical conductors of a tape or ribbon type and derivations made with a single-pole type standard cable. It is prepared in such a manner that the tape type conductor has only one way of installation.

The branch cables can only be placed previously peeled and in order to make an electrical connection, the two screws have to be tightened.

Each branch conductor has one of the multipolar tape conductors assigned. This configuration is already predetermined and it cannot be changed. In order to change the connections between conductors, they should be switched off and connected again on the selected terminal.

Among the limitations of this device are:

It is only useful to connect single-pole cables to a multipolar cable and for electric current low voltages.

It does not contain holes on the three axis neither connection metal bars.

It cannot feed switchgears or circuit breakers on its own.

It is not modular It cannot be assembled along with other similar pieces.

Only a small quantity of conductors can be connected in relation to the quantity of conductors that the tape type cable has.

No more circuits can be added.

To know the correspondence between the tape conductors and the branch conductors, it is necessary to disassemble the insulation sheath.

The different connections cannot be viewed.

U.S. Pat. No. 6,000,963 and E.P. Patent 0 892 462 refer to devices which transform the end of an electrical conductor into a plug type connector socket able to receive a specific socket plug.

In general terms, the electrical conductor is placed peeled and only by its end, which means it is not through.

It cannot feed switchgears or circuit breakers on its own. It is not modular. It cannot be assembled with other similar pieces.

It has only two holes, only one of them being through. It does not use a connection metal bar. In order to connect it, special tools are needed.

While it is not joined to the corresponding socket plug, it is dangerously exposed to a large metal part with electrical voltage.

In addition, it is not an integral connection system.

U.S. Pat. No. 1,030,817 discloses a device which transforms the end of an electrical conductor into a plug type connector socket able to receive a specific socket plug.

It cannot feed switchgears or circuit breakers on its own. It is not modular. It cannot be assembled with other similar pieces.

It has only two holes but none of them is through. It does not use a connection metal bar.

This device is not an integral connection system, either.

OBJECTS AND ADVANTAGES

In general terms, the present modular connection assembly comprises modular parts which can adopt different configurations as needed.

A very significant advantage is that the sheaths of conductor cables need not be peeled as they are simply introduced into the corresponding conduct and then the fixing screw allows to perforate the sheath making the contact between the conductor core and the bridge.

Therefore, the present connection assembly does not require switching off the electrical power since there is no risk in working on it.

Furthermore, it relates to a system which allows for a significant quickness to carry out connection and disconnection jobs on all types of circuits, either two-pole, three-pole or four-pole. In addition, circuits can be added or removed as needed.

This easy operation allows to modify easily the sequence of phase rotation. It also facilitates quick, temporary or definitive disconnection of different circuits.

The significant operative flexibility of the present connection assembly allows for its adaptation to few or many circuits, whether they are single-phase or three-phase. Parallel connections of different amounts of poles can be settled, even placed consecutively or alternatively. This is achieved by means of a modular arrangement which allows to configure the system according to each particular situation and without limitations or restrictions as to shape or quantity. The three main pieces can be assembled in different shapes, according to the different needs.

The present connection assembly allows for a rational use since it only allows the use of the necessary pieces without unnecessary surplus or waste.

Furthermore, it is reusable and circuits can be added or removed easily.

The use of special tools is not necessary.

The connected elements (e.g., switchgears) are easily replaced without having to disassemble the whole system.

The whole system can be assembled, connected and disconnected even under voltage. The cost is lower than any other similar system.

It is not necessary to peel the cables, they are introduced already insulated. This reduces dramatically the times of installation and increases safety.

In a case of three-phase connection, the sequence of phase rotation can be changed just by changing the locations of two screws, with or without voltage.

It allows to modify the origin of each single-phase circuit, with or without voltage, in order to keep the load balance between phases.

It is possible to know the status and place of each connection visually, that is visualization is graphic.

DESCRIPTION OF THE DRAWINGS

For the sake of clarity and understanding of the object of the invention, the present device is illustrated in different figures in which it has been represented in one of the preferred embodiments, by way of example and not by limitation.

Figure 1:
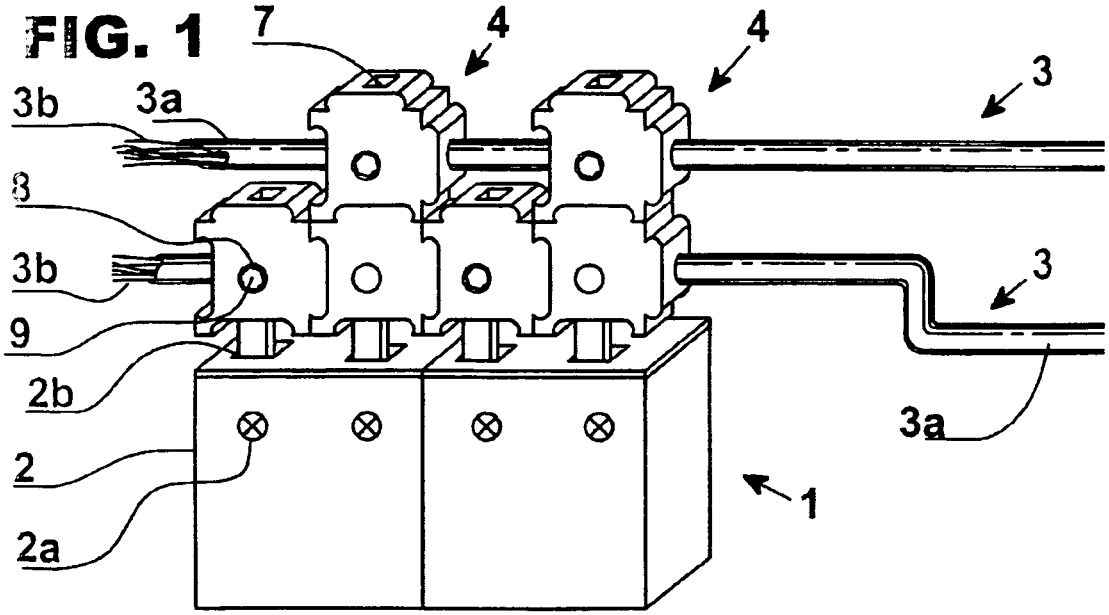
FIG. 1 is a perspective view of the present modular connection assembly applied to the terminal of an electrical device.
Figure 2:
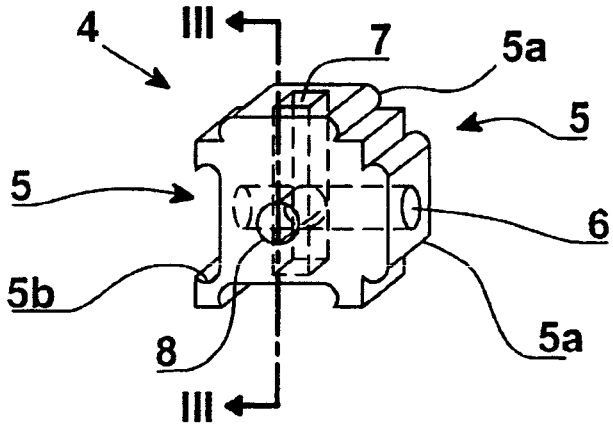
FIG. 2 is a perspective view of the insulating connector on which walls the side socket member can be observed. Broken lines show the arrangement of the passages which go across it.
Figure 3:
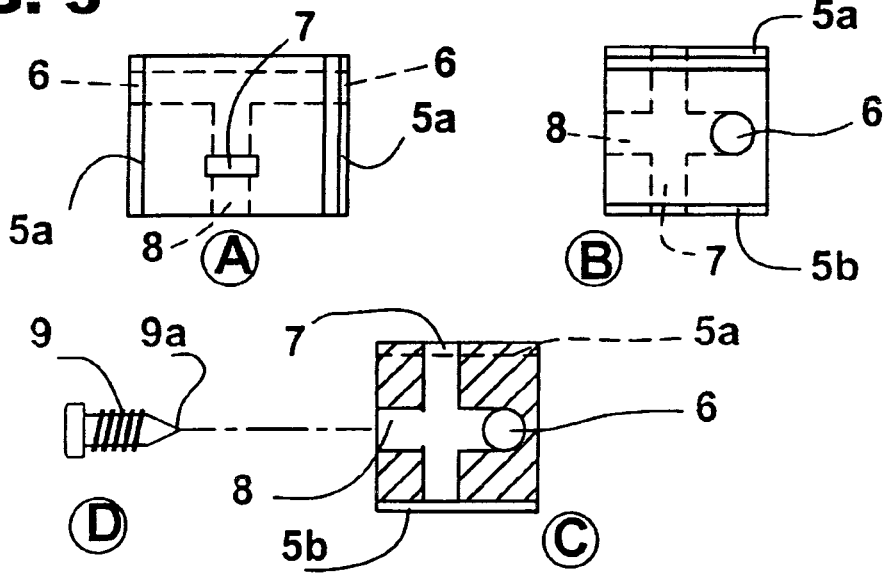
FIG. 3 includes drawings A, B, C and D, where.
Figure 4:
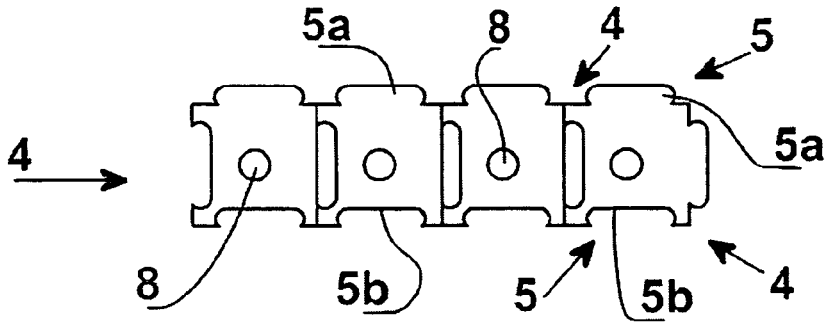
Figure 5:
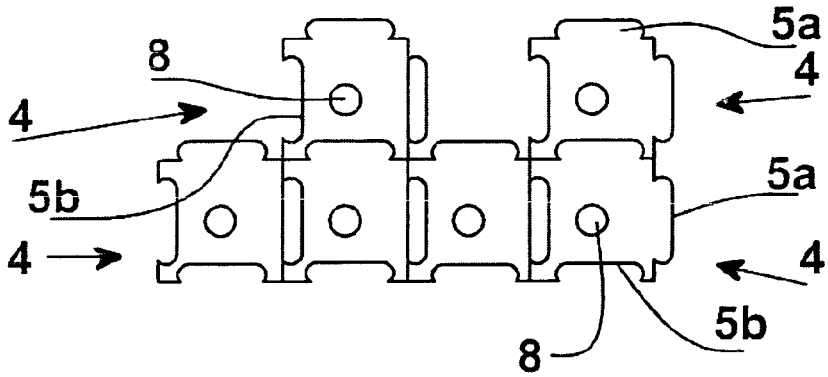

Drawing A is a top view of the connector where the second passage intended to the bridges can be seen;

Drawing B is a side view of the connector where the first passage intended to the conductor cables can be seen;

Drawing C is a cross section of the connector according to a section which appears as Ill-ill in FIG. 2; and Drawing D is a side view of the fixing and contact screw;

FIG. 4 is a front view, elevated, of a set of connectors inserted and grouped at a first level;

FIG. 5 is a front view, elevated, of a set of connectors inserted and grouped in two levels: a first lower level and a second upper level.

Figure 6:
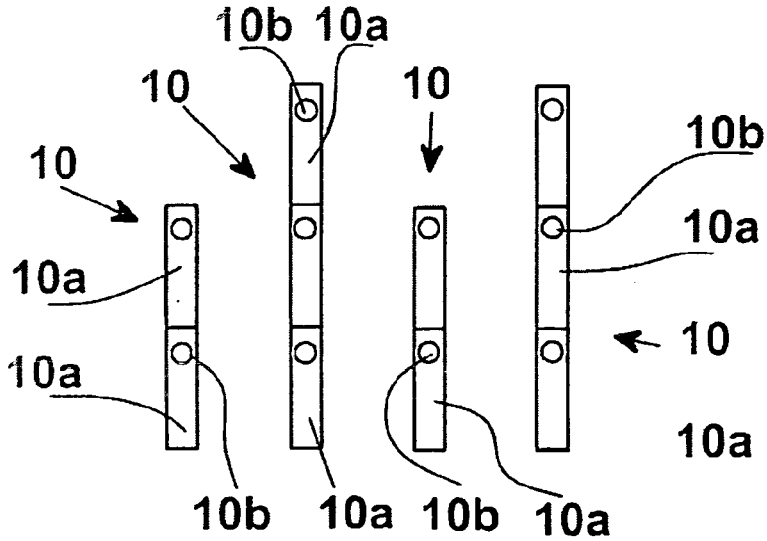
Figure 7:
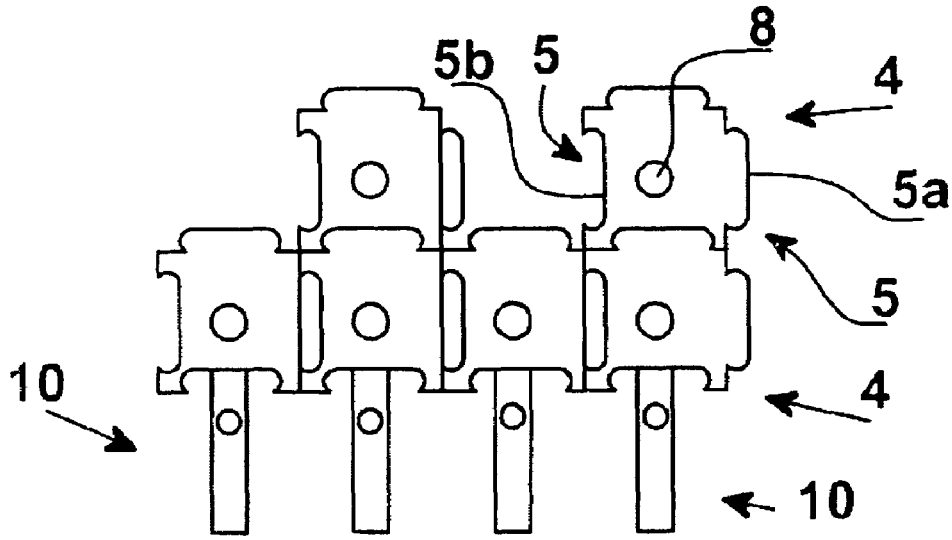
Figure 8:
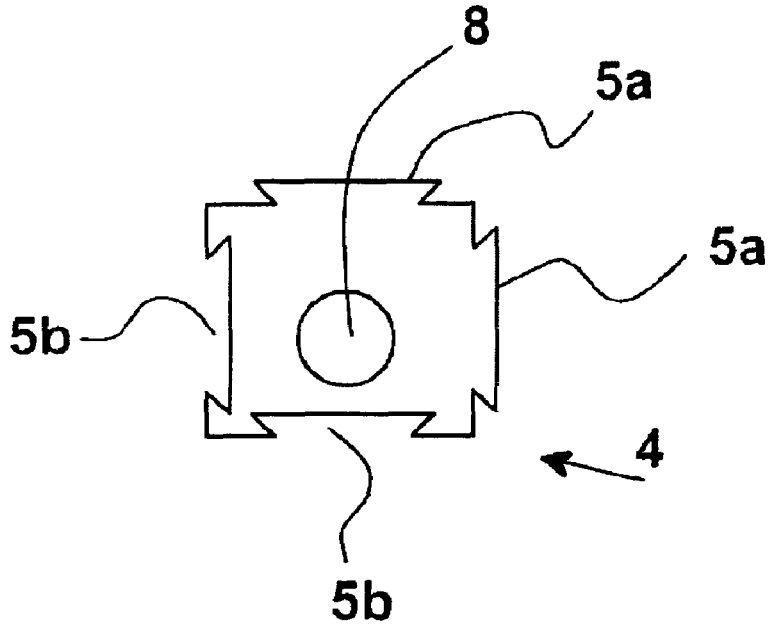

FIG. 6 is a front view, elevated, of several modular bridges prepared for different lengths;

FIG. 7 is a front view, elevated, of a modular set assembled and prepared to connect a two-pole power line to two electrical devices;

FIG. 8 is a front view, elevated, of the connector in an embodiment where the socket members have edged rims.

In the different views, the same reference numerals and/or letters apply to the same or similar parts.

| Reference Numerals in Drawings: | |
|---|---|
| (1) | Application electrical device. |
| (2) | Device terminal (1). |
| (2a) | Connection fasteners. |

-continued

| Reference Numerals in Drawings: | |
|---|---|
| (2b) | Input passage. |
| (3) | Cable conductor. |
| (3a) | Insulating sheath. |
| (3b) | Conductor core. |
| (4) | Insulating connector. |
| (5) | Side socket member. |
| (5a) | Side socket plug member. |
| (5b) | Side connector socket member. |
| (6) | First passage. |
| (7) | Second passage. |
| (8) | Third connection passage. |
| (9) | Fixing and contact screw [fixing and contact members]. |
| (9a) | Contact end. |
| (10) | Bridge. |
| (10a) | Modular sections of the bridge (10). |
| (10b) | Threaded holes. |

DETAILED DESCRIPTION

In general terms, the present invention consists of a modular connection device or assembly which comprises a connector (4) made of insulating material, a joining conduction bridge (10) and a fixing and contact members (9); the connector (4) has side socket member (5) for its connection to similar units (4) and it also has some passages (6)(7)(8) for cables (3), for bridges (10) and for fixing member (9); the bridge (10) comprises modular sections (10*a*) and threaded holes (10*b*) for the fixing member (9); the fixing member (9) can be a screw which ends in a contact end (9*a*) able to perforate the sheath (3*a*) of the conductor cable (3).

More particularly, the present modular connection assembly is applicable to the connection of the electrical conductor cables (3), generally integrated by a conductor core (3*b*) and an insulating sheath (3*a*), and devices such as switchgears, switchboards, terminals (2) and other electrical connection elements.

This modular connection assembly comprises a connector (4) structured in electrically insulating material, for example, a plastic material. The main body of the connector (4) can show an approximately prismatic shape and on its side faces, it has side socket member (5).

These side socket member (5) comprise side socket plug member (5*a*) and side connector socket member (5*b*) which allow to group several connectors (4) relating them to each other. In the present embodiment, the side socket plug member (5*a*) are located on side faces opposite to the side connector socket member (5*b*).

On the other hand, the connector (4) is crossed by a series of cross sectioned passages (6)(7)(8). It is a first passage (6) with circular section which goes longitudinally across the connector (4), in a horizontal sense, and which is intended to house a conductor cable (3). The second passage (7) with a rectangular section goes through the connector (4) longitudinally, in a vertical sense, and is intended to house a bridge (10), The third passage (8) is cross-sectioned respective the first (6) and the second (7) passages, which communicates to each other. In this third passage (8) there is a fixing and contact screw (9).

The bridges (10) can consist of prismatic and elongated bars—for example, a rectangular profile—structured in an electrically conducting material. These bridges (10) comprise a series of modular sections (10*a*) which can be discarded according to the length required to perform the connection. Each modular section (10*a*) has a respective threaded hole (10*b*) fit to the assembly of a fixing member (9).

In addition, the fixing member (9) can consist of an electrically conducting metal screw which main body is threaded to be connected to the threaded holes (10*b*) of the bridges (10). On an end of the fixing screw (9), there is a command head, whereas on the opposite side, there is a contact end (9*a*)—conical for example—able to perforate the sheath (3*a*) of the conductor cable (3).

OPERATION

The side socket member (5) allow to group several connectors (4) which are integrated in a connection modular set.

The conductor cables (3) are inserted into the first passage (6) of the connectors (4). The bridges (10), after cutting and separating the unnecessary modular sections (10*a*), are inserted into the second passage (7) of said connectors (4). The fixing screw (9) is threaded into the threaded hole (10*b*) of the bridge (10) until its contact end (9*a*) perforates the sheath (3*a*) of the conductor cable (3) and makes contact with its conductor core (3*b*). The external ends of the bridges (10) may be inserted in the input passage (2*b*) of the electrical device (1).

For example, to connect a single-phase power line to two electrical devices (1)—for example, two switchgears—six connectors are used (4). In order to separate the connections of the conductor cables (3), connectors (4) are overlapped vertically so that the input of one of the cables (3) remains higher than the other input. In the overlapped connectors (4), the lower connector (4) acts only as a passage of the cable and the bridge (10).

It is apparent that when the present invention is put into practice, modifications may be made regarding certain construction and shape details, without departing from the basic principles which are clearly encompassed in the following claims.

What is claimed is:

1. A modular connection assembly applicable to make electrical application connections of conductor cables having an insulating sheath and a conductor core—to an application electrical device, which comprises:

at least a connector provided with side socket members structurally arranged to connect with other connectors;

at least a bridge as a connecting member between said connector and the application electrical device;

wherein said connector includes at least three cross sectioned passages which comprise a first passage for the conductor cable, a second passage for said bridge and a third passage which communicates with said first and second passages and which is structurally arranged to house a conductor fixing member;

wherein said fixing member includes an end able to perforate the insulating sheath of the conductor cable, to provide a connection member between the cable and said bridge; and when said connectors provided with said side socket members are connected to other connectors, said first passages within said connected connectors are axially aligned to receive a conductor cable and said second passages within said connected connectors are axially aligned to receive a bridge.

2. The modular connection assembly in accordance with claim 1, wherein said side socket members are of the socket plug and connector socket type.

3. The modular connection assembly in, accordance with claim 2, wherein said side socket member are on opposite sides of said side connector socket members.

4. The modular connection assembly in accordance with claim 1, wherein said connector is an insulating material and said bridges and said fixing members are an electrical conducting material.

5. The modular connection assembly in accordance with claim 1, wherein said fixing member is a conductor metal fixing which, by means of a thread provided by said bridge, is structurally arranged to perforate the conductor cable thereby acting as a connection member between the cable and said bridge.

6. The modular connection assembly in accordance with claim 5, wherein said fixing member includes on one end a command end and, on the opposite end, a conical contact end able to perforate the sheath of the conductor cable.

7. The modular connection assembly in accordance with claim 1, wherein said three cross sectioned passages in said connector comprise:

said first passage for the conductor cable extends through said connector in a horizontal, longitudinal sense;

said second passage for bridges extends through said connector in a vertical, longitudinal sense; and said third connection passage which is structurally arranged to house a fixing member, extends through said connector in a cross sectional manner to communicate said first passage to said second passage.

8. The modular connection assembly in accordance with claim 7, wherein said first passage for said cable has a circular section and said second passage for bridges has a rectangular section.

9. The modular connection assembly in accordance with claim 1, wherein said bridge is a rectangular prismatic bar.

10. The modular connection assembly in accordance with claim 1, wherein said bridge comprises a series of modular sections positioned according to the length required in the application connection and said modular sections are provided with threaded holes for the attachment of said fixing member.

* * * * *